US006055667A

United States Patent [19]

Jimenez

[11] Patent Number: 6,055,667

[45] Date of Patent: May 2, 2000

[54] BABY BOTTLE AND SIP CUP BIB SUPPORT

[76] Inventor: Diane Jimenez, 7 Adams Ct., Oyster Bay, N.Y. 11771

[21] Appl. No.: 09/211,123

[22] Filed: Dec. 14, 1998

[51] Int. Cl.[7] ..... A41B 13/00; A47D 15/00

[52] U.S. Cl. ..... 2/49.1; 2/49.2; 248/102

[58] Field of Search ..... 2/49.1, 49.2, 49.4, 2/49.5; 248/102, 103, 104, 105, 106, 107

[56] References Cited

U.S. PATENT DOCUMENTS

| | | | |
|---|---|---|---|
| D. 379,660 | 6/1997 | Aube . | |
| 2,134,746 | 11/1938 | Allen . | |
| 2,450,927 | 10/1948 | Allen . | |
| 2,451,718 | 10/1948 | Corrao . | |
| 2,485,461 | 10/1949 | Siegel . | |
| 2,510,953 | 6/1950 | Brose et al. . | |
| 2,526,121 | 10/1950 | Curry et al. . | |
| 2,631,288 | 3/1953 | Daust . | |
| 2,651,485 | 9/1953 | Schutz . | |
| 3,584,818 | 6/1971 | Essman | 248/105 |
| 4,227,270 | 10/1980 | Rivera | 5/639 |
| 4,405,106 | 9/1983 | Adler . | |
| 4,473,907 | 10/1984 | Maillard . | |
| 4,726,551 | 2/1988 | Randall et al. . | |
| 4,809,938 | 3/1989 | Skinner et al. | 248/102 |
| 4,895,327 | 1/1990 | Malone et al. . | |
| 5,022,616 | 6/1991 | Kordecki . | |
| 5,183,229 | 2/1993 | Duggan . | |
| 5,184,796 | 2/1993 | Maher . | |
| 5,188,320 | 2/1993 | Polka | 248/103 |
| 5,217,192 | 6/1993 | Oktayuren | 248/102 |
| 5,624,090 | 4/1997 | Gammelgaard | 248/102 |
| 5,765,225 | 6/1998 | Goeckeritz et al. . | |
| 5,769,367 | 6/1998 | Bradley et al. . | |
| 5,871,184 | 2/1999 | Kaopio | 248/102 |

*Primary Examiner*—William Stryjewski
*Assistant Examiner*—Shirra L. Jenkins
*Attorney, Agent, or Firm*—Michael I. Kroll

[57] ABSTRACT

This application discloses a bib 10 having a strap 24 for being worn around the neck of an infant 12. The bib 10 has a compartment 18 within it which houses an irregular shaped wedge 20 made of foam-like material. The wedge 20 can be placed in different positions within the bib 10 so as to change the angle of a bottle 14 in communication with the infant's mouth. Multiple releasable straps 16 connected to the bib 10 hold a bottle 14 or sip cup 38 onto the outer surface of the bib 10. Means for connecting the ends of the straps 16 are disclosed, including buttons 32, snaps 34, hooks 36, and hook and loop material 28. Also mating pieces of hook and loop material means 26 are disclosed for connecting the neck strap 24 of the bib 10 to the back of the neck of the infant 12. An alternative embodiment discloses multiple elastic straps extending from one side of the bib 10 to the other for holding the bottle 14 or sip cup 38 to the bib 10.

19 Claims, 9 Drawing Sheets

BABY BOTTLE AND SIP CUP BIB SUPPORT

BACKGROUND OF THE INVENTION

1. Field of the Invention

The present invention relates generally to an apparatus for holding a baby bottle or sip cup while feeding an infant, and, more particularly, to a bib having a strap having a length of hook and loop material fastened to the end of said strap whereby said bib strap can be fastened around the neck of an infant and further said bib having a compartment with means for closure and wherein a contoured wedge of foam-like material can be inserted in varying positions, depending on the position of the infant, to support a bottle or sip cup while the infant is feeding and said bib having a number of elastic straps extending from side to side and attached thereto for holding said bottle or sip cup in the selected position.

2. Description of the Prior Art

There are other bib and baby bottle holders designed to hold a bottle while an infant feeds. Typical of these is U.S. Pat. No. 4,405,106 issued to Adler on Sep. 20, 1983.

Another patent was issued to Maillard on Oct. 2, 1984 as U.S. Pat. No. 4,473,907. Yet another U.S. Pat. No. 4,726,551 was issued to Randall et al. on Feb. 23, 1988 and still yet another was issued on Jan. 23, 1990 to Malone et al. as U.S. Pat. No. 4,895,327. Another patent was issued to Kordecki on Jun. 11, 1991 as U.S. Pat. No. 5,022,616. Yet another U.S. Pat. No. 5,765,225 was issued to Goeckeritz et al. on Jun. 16, 1998 and still yet another was issued on Jun. 23, 1998 to Bradley et al. as U.S. Pat. No. 5,769,367.

U.S. Pat. No. 4,405,106

Inventor: Teri A. Adler

Issued: Sep. 20, 1983

A baby bottle holder includes a base for resting upon the chest of an infant, a bottle holding member hinged to the forwardmost edge of the base for extending upwardly and rearwardly therefrom, and a prop hinged to the rear end of the bottle holding member for engaging the base portion at one of a plurality of points disposed at varying distances from the forwardmost edge thereof to vary the angle at which the baby bottle is held. The bottle holding member includes a clamp for releasably engaging a conventionally-sized baby bottle. The base, bottle holding member and a prop are preferably formed as a single piece using a plastic molding or forming process to provide living hinges between the base and the bottle holding member and between the bottle holding member and the prop.

U.S. Pat. No. 4,473,907

Inventor: Susan Maillard

Issued: Oct. 2, 1984

A combined enclosure and support for an infant's feeding bottle in which the bottle is inserted with the nipple projecting upwards in a position to facilitate the infant's feeding itself. The invention is formed of two principal portions, a bib which covers the chest area and a lower appended enclosure for the bottle. Straps attached to the bib are provided for securing the bib about the infant's neck. The enclosure contains an outward facing vertical slot. Across this slot are horizontal elastic straps that are separated from one another in the vertical direction. The spacing between the elastic straps permits a visual determination of the amount of fluid remaining in the bottle without removal, while the elasticity of the straps accommodates a variety of bottle sizes. The bib and enclosure, in one embodiment, are formed of quilted material to provide insulation designed to maintain the bottle at its initial temperature. The bib may also be secured about the nipple to preserve its sanitary condition prior to use by the infant. Another embodiment utilizes paper of various forms to provide all the components, thereby permitting the bib to be disposed of after each use.

U.S. Pat. No. 4,726,551

Inventor: Randall et al.

Issued: Feb. 23, 1988

This baby bottle holder enables a baby to feed from a bottle unassisted. Primarily, it consists of a pillow with a body wrap attached that includes flaps for securing it to the baby. It also includes a bottle holder block attached to one flap, which is provided with an elastic strap that holds and retains the baby bottle.

U.S. Pat. No. 4,895,327

Inventor: Malone et at.

Issued: Jan. 23, 1990

An apparatus is disclosed which aids in the feeding of an infant while the infant is placed face-up on a substantially planar feeding surface with its torso in a substantially prone position. The feeding apparatus has a center section for placement across the front of the torso of the infant during feeding. A first anchor section having two ends is coupled to the center section at one end and weighted at the opposite end for placement along one side of the torso of the infant during feeding. A second anchor section having two ends is coupled at one end to the center section opposite from and axially aligned with the first anchor section. It is weighted at the opposite end for placement along the side of the torso of the infant during feeding. The first and second anchor sections cooperate to anchor the apparatus to the feeding surface, to secure the center section in position across the front of the torso of the infant, and to minimize side-to-side movement of the apparatus, while minimizing the amount of weight placed on the infant's torso. A means is provided for securing the bottle to the center section in a position aligned with the infant's torso, within the infant's reach.

U.S. Pat. No. 5,022,616

Inventor: John Kordecki

Issued: Jun. 11, 1991

A system for bottle feeding an infant comprising a bib 14, a base 16 adapted to rest on the infant, a bottle holder 18 hingeably attached to the base 16 for securing a bottle thereto, and a bib slot 20 operatively associated with the base for frictionally engaging the bib 14 so that the bib 14 is held to the base securely for purposes of feeding an infant and can be slid in and out of the slot means as desired. Pressure sensitive adhesive strips 31 and 33 may be added to bib 14 to hold the bib 14 to the infant. The bottle holder 18 is continuously angularly adjustable along a mast 22 to finely and continuously adjust the feeding rate. One end 32 of the bottle holder 18 presents a flat edge so that the bottle holder may be placed on a flat surface to position a bottle B in an upright position when the system 10 is not in use on the infant. The base 16 is contoured to fit an infant's torso with portions 48 engaging the infant's inner thigh to support the base.

U.S. Pat. No. 5,765,225

Inventor: Goeckeritz et al.

Issued: Jun. 16, 1998

A baby bib having a bottle holding capability. The bib has an attached bottle-holding structure which maintains a baby bottle in a predetermined position, both laterally and longitudinally. The bottle holding attachment is made of a soft structural material covered with a fabric material similar to the bib fabric. The bottle holder may also be made with a harness attached to it so that it may be held in place without being attached to a bib.

U.S. Pat. No. 5,769,367

Inventor: Bradley et al.

Issued: Jun. 23, 1998

An apparatus for propping a nursing bottle so that an infant child can drink from the bottle includes a bottle holding portion; and an apparatus mounting portion including at least two manually diverging first flexible members for abutting the sides of the torso of an infant child to removably secure the apparatus to the child with friction engagement. The first flexible members preferably each include pliant material for bending by hand to conform to and fit against the waist of an individual child. The first flexible members alternatively each include resilient material having elastic memory and pre-shaped to lightly resiliently grip the front and sides of the infant waist. The first flexible members are preferably at least partially covered with or contain a high friction material. The high friction material is preferably non-toxic rubber tubing. The bottle holding portion preferably includes at least two mutually diverging second flexible members for abutting the sides of the nursing bottle in the apparatus. The apparatus preferably additionally includes a pliant and flexible connecting link interconnecting the bottle holding portion and the apparatus mounting portion, for positioning the nursing bottle holding portion, and thereby positioning the bottle, relative to the mouth of the child. Toys having ring portions are preferably slidably mounted on the connecting link. The apparatus preferably glows in the dark for night time parental monitoring.

While these bottle holding devices may be suitable for the purposes for which they were designed, they would not be as suitable for the purposes of the present invention, as hereinafter described.

SUMMARY OF THE INVENTION

The present invention discloses a bib having a strap for being worn around the neck of an infant. The bib has a compartment within it which houses an irregular shaped wedge made of foam-like material. The wedge can be placed in different positions within the bib so as to change the angle of a bottle in communication with the infant's mouth. Multiple releasable straps connected to the bib hold a bottle or sip cup onto the outer surface of the bib. Means for connecting the ends of the straps are disclosed, including buttons, snaps, hooks, and hook and loop material. Also mating pieces of hook and loop material means are disclosed for connecting the neck strap of the bib to the back of the neck of the infant. An alternative embodiment discloses multiple elastic straps extending from one side of the bib to the other for holding the bottle or sip cup to the bib.

A primary object of the present invention is to provide an infant feeding bib wherein a bottle or sip cup can be attached at an appropriate angle.

Another object of the present invention is to provide an infant feeding bib which has a compartment wherein a foam-like wedge can be inserted to support a bottle or sip cup at an appropriate angle or said compartment can be used to store snacks for the infant.

Yet another object of the present invention is to provide an infant feeding bib which has straps with a length of hook and loop material for attaching and detaching said bib quickly and easily around the infant's neck.

Still yet another object of the present invention is to provide an infant feeding bib which can be a plastic, vinyl laminated, cotton or terry cloth-like material on the outside to protect or absorb fluids from the bottle or the infant's mouth.

Another object of the present invention is to provide an infant feeding bib which has a number of elastic straps attached at each side wherein a baby bottle or sip cup can be inserted with or without the foam wedge.

Additional objects of the present invention will appear as the description proceeds.

The present invention overcomes the shortcomings of the prior art by providing an infant feeding bib wherein a bottle or sip cup can be attached to the bib at an appropriate feeding angle from an infant's prone position to sitting erect as in a car seat and said bottle or sip cup can be retained in said position by a number of elastic straps. The compartment of said infant feeding bib can be used for the storage of snacks after removal of the foam-like wedge. The infant feeding bib can be made from a durable washable and absorbent material as well as being a variety of plastic vinyl materials to protect the infant from spills.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
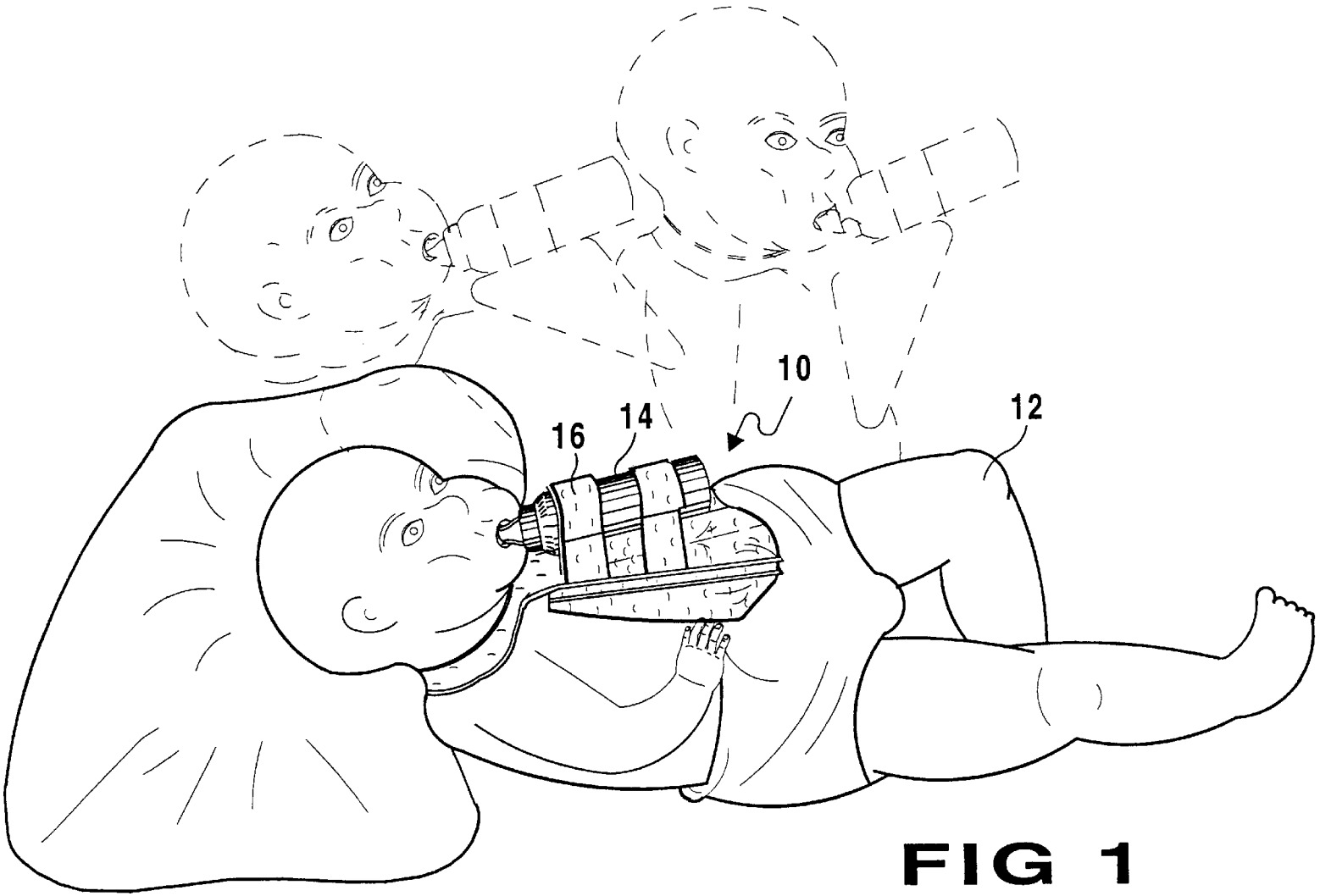
FIG. 1 is a perspective view of the present invention in use whereby an infant in a prone position is wearing the infant feeding bib with the foam-like material wedge keeping the bottle at an appropriate feeding angle and said bottle is being retained in said position by a number of elastic straps. Also shown in outline are alternate rotations for the foam-like wedge to maintain proper feeding angle for an infant.

Turning now descriptively to the drawings, in which similar reference characters denote similar elements throughout the several views, FIGS. 1 through 9 illustrate the present invention being an infant feeding bib.

Turning to FIG. 1, therein is shown a perspective view of the present invention, generally shown at 10, in operative connection with an infant 12 which is lying in a prone position. The infant is wearing the infant feeding bib 10 which has a wedge (not shown) in its interior compartment (not shown) which keeps the bottle 14 at an appropriate feeding angle. The bottle 14 is being retained in position by bottle holding means being in one embodiment multiple elastic straps 16 located on the outside of the bib on its upper surface. Also shown in FIG. 1 in outline are alternative positions or rotations for the wedge to maintain proper feeding angles for the infant 12 also shown in various feeding positions.

Figure 2:
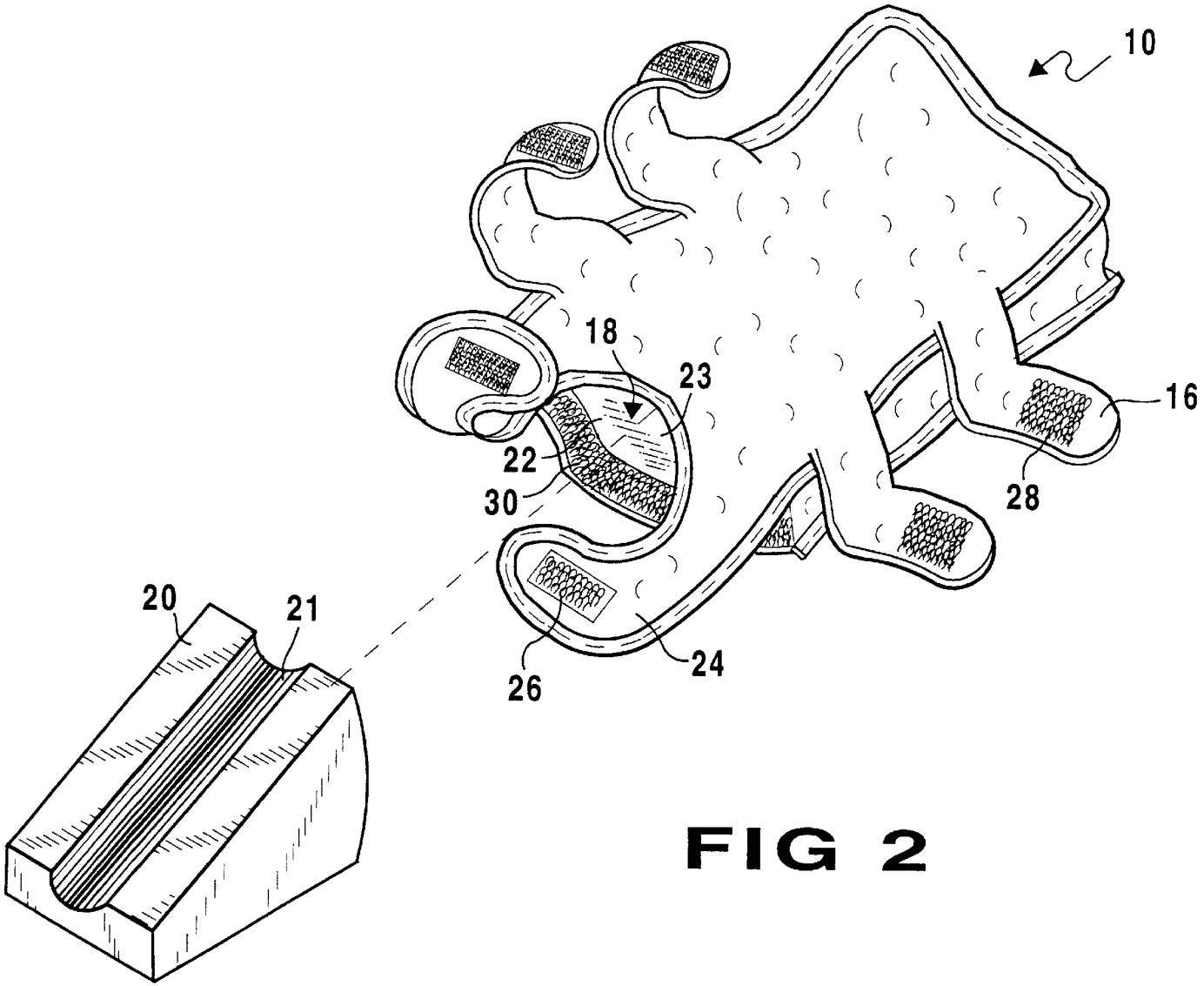
FIG. 2 is an enlarged view of the two members of the present invention. The foam-like wedge can be inserted into the bib compartment at the appropriate angle for feeding and the wedge can be removed for storage of snacks in the bib compartment.

Turning to FIG. 2, therein is shown an enlarged view of the two basic members of the present invention 10. Therein is shown the irregular shaped wedge 20 made of foam-like material and the bottle holding bib member 10, the foam-like wedge 20 placing a bottle at an appropriate angle for feeding a child. Also shown is the inner bib compartment 18 and the opening into the bib compartment 22 wherein the foam-like wedge 20 is inserted. The wedge 20 has a groove 21 cut in its surface for accommodating the circular shape of a bottle (not shown). Also shown are the bib neck straps 24 which encircle the infant's neck for holding the bib 10. The neck straps 24 connect to each other with mating hook and loop material 26 which allows quick and easy attachment and detachment of the bib from the baby's neck. Also shown is an embodiment showing the multiple bottle holding straps 16 connecting to each other with mating hook and loop material 28. Also shown therein is the mating hook and loop material 30 which closes the opening of the compartment within the bib 10. The compartment 18 can be lined with plastic or like material 23 which compartment can be used to store snacks when not in use for bottle feeding the baby. The bib 10 can be made of plastic, vinyl laminate, cotton or terry cloth-like material for absorbing fluids from the bottle or mouth of infant. Note also that while not shown on the drawings, the inner irregularly shaped wedge could also be made of an air bladder so that the size of the wedge could be adjusted by adding or removing air from the bladder by means of an air inlet means such as a valve.

Figure 3:
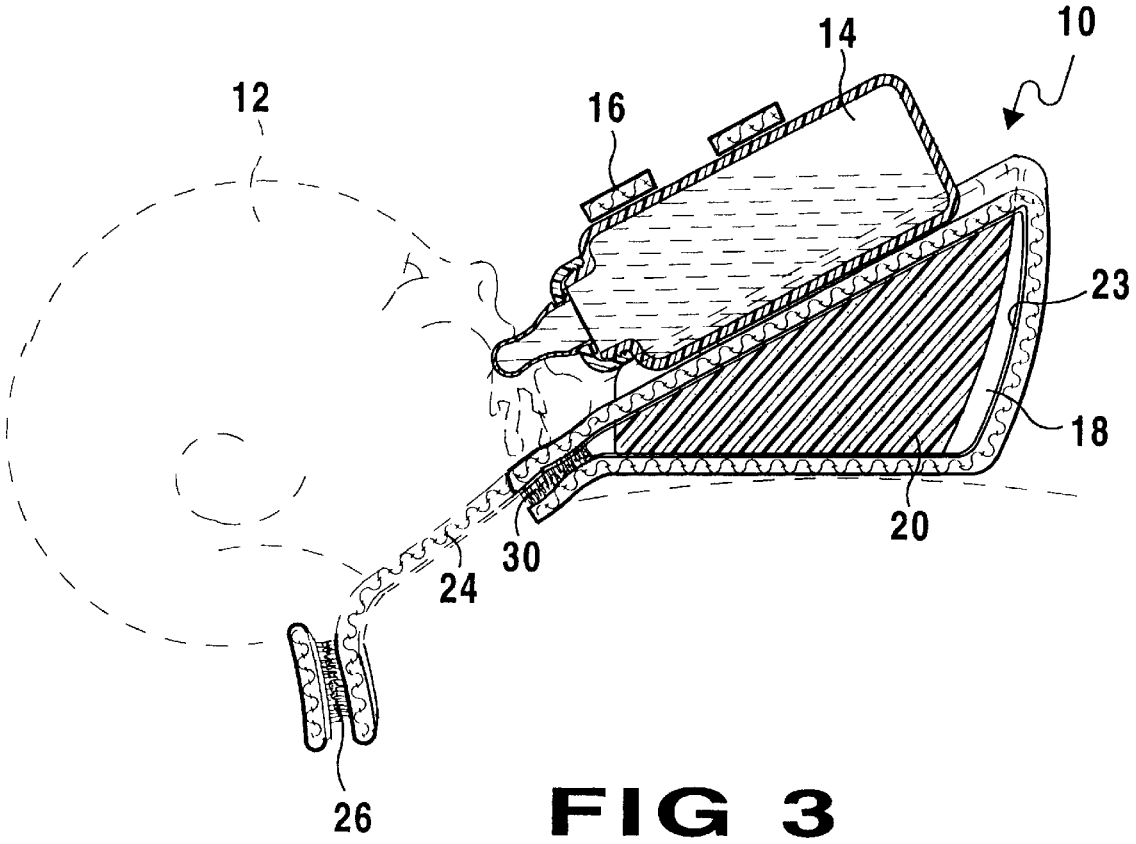
FIG. 3 is a diagrammatic sectional view of the present invention in use whereby the bottle and nipple are kept at an appropriate feeding angle by a number of elastic straps while the infant is in a prone position.

Turning to FIG. 3, therein is shown a diagrammatic sectional view of the present invention 10 in operative connection whereby the bottle 14 and nipple are retained at an appropriate feeding angle by multiple elastic straps 16 holding the bottle 14 while the infant 12 is in a prone position. Also shown therein are the bib compartment 18 holding the wedge 20 being closed at its opening by hook and loop material 30 and the neck straps 24 also being attached to each other behind the infant's neck with hook and loop material 26. The liner 23 is also shown on the interior of the compartment 18.

Figure 4:
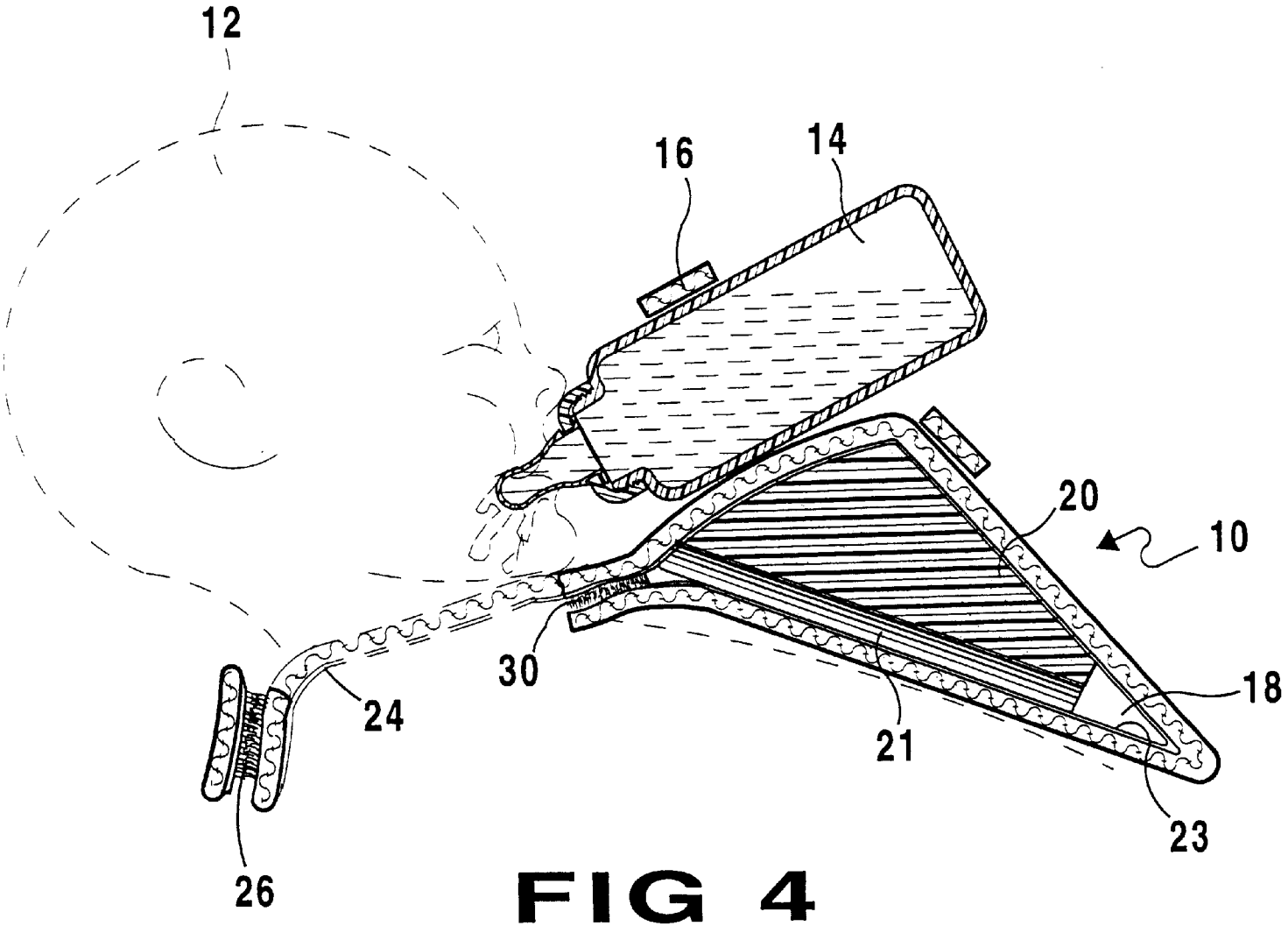
FIG. 4 is a diagrammatic sectional view of the present invention in use whereby the bottle and nipple are kept at an appropriate feeding angle by a number of elastic straps while the infant is in a reclined position.

Turning to FIG. 4, therein is shown a diagrammatic sectional view of the present invention 10 in operative connection with an infant 12 wherein the bottle 14 and nipple are kept at an appropriate feeding angle by the wedge 20 and the bottle 14 held by multiple straps 16 while the infant is in a reclining position. In FIG. 4 the wedge 20 is rotated to a different alternative position so as to change the angle at which the bottle 14 is presented to the infant 12. Also shown therein are the bib compartment 18 holding the wedge 20 being closed at its opening by hook and loop material 30 with the neck straps 24 being attached to each other behind the infant's neck with hook and loop material 26.

Figure 5:
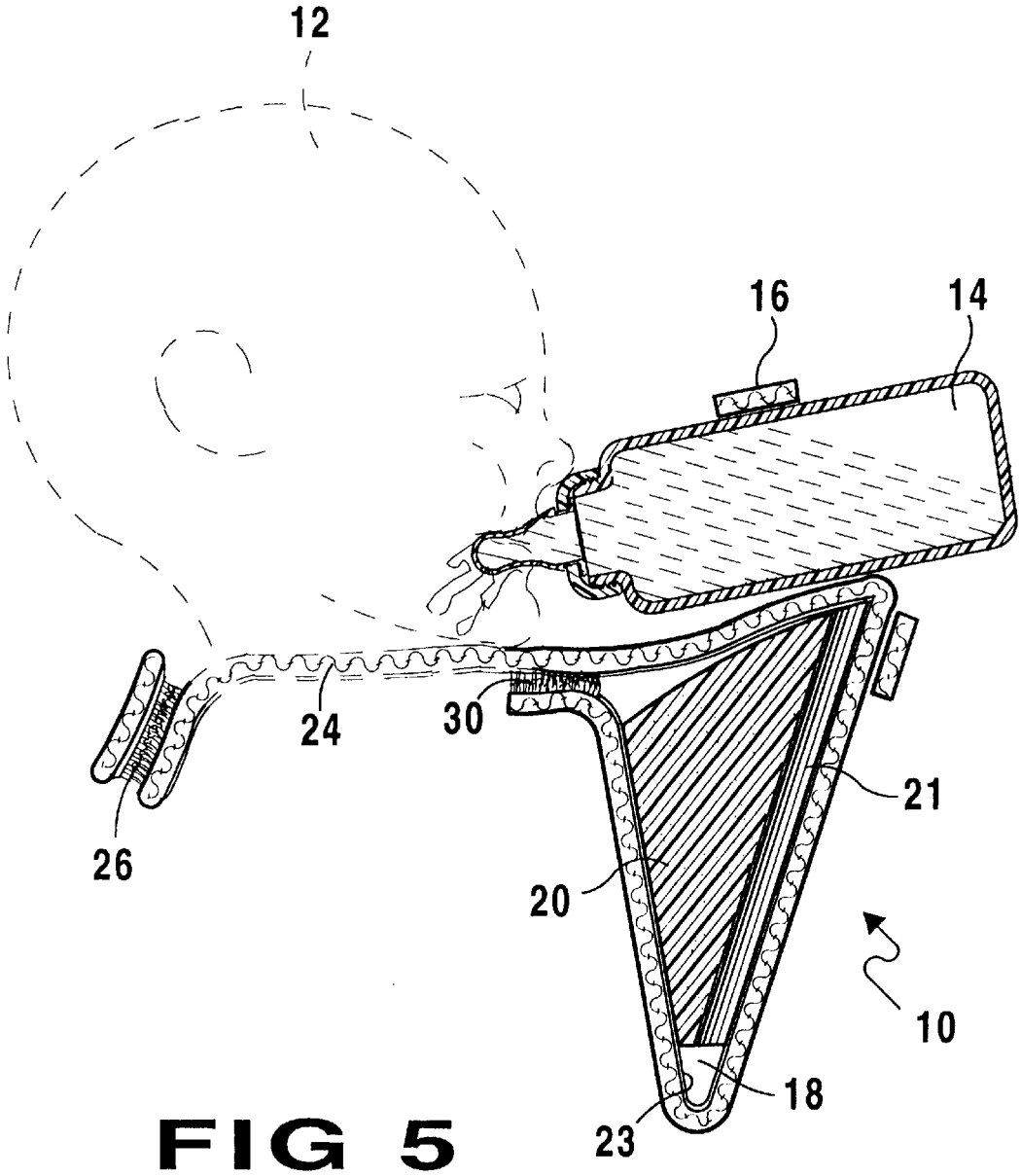
FIG. 5 is a diagrammatic sectional view of the present invention in use whereby the bottle and nipple are kept at an appropriate feeding angle by a number of elastic straps while the infant is in a sitting position.
Figure 6A:
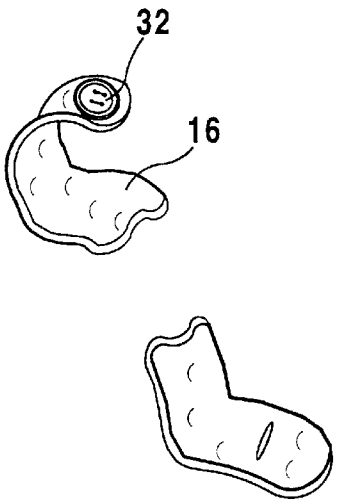
FIG. 6A–6D are alternate means of closure for the straps which can be used in place of the elastic straps for holding the bottle or sip cup to the infant feeding bib.
Figure 6B:
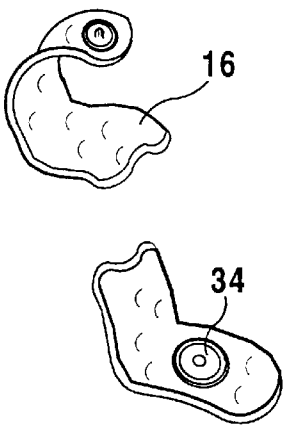
Figure 6C:
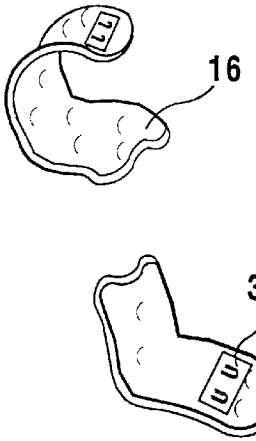
Figure 6D:
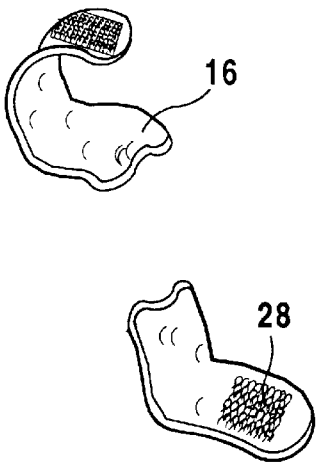

Turning to FIG. 5, therein is shown a diagrammatic sectional view of the present invention 10 in operative connection with an infant 12 wherein the bottle 14 and nipple are kept at an appropriate feeding angle by the wedge 20 and by straps 16 while the infant is in an upright position. In FIG. 4 the wedge 20 is rotated to a different position so as to change the angle at which the bottle 14 is presented to the infant 12. Also shown therein are the bib compartment 18 holding the wedge 20 being closed at its opening by hook and loop material 30 with the neck straps 24 o being attached to each other behind the infant's neck with hook and loop material 26.

Turning to FIG. 6A–6D, therein are shown alternate means of closures for the straps 16 which can be used in place of the elastic straps (not shown) for holding the bottle or sip cup to the infant feeding bib. Therein are shown means for closure including buttons 32, snaps 34, hooks 36, and mating hook and loop material 28.

Figure 7:
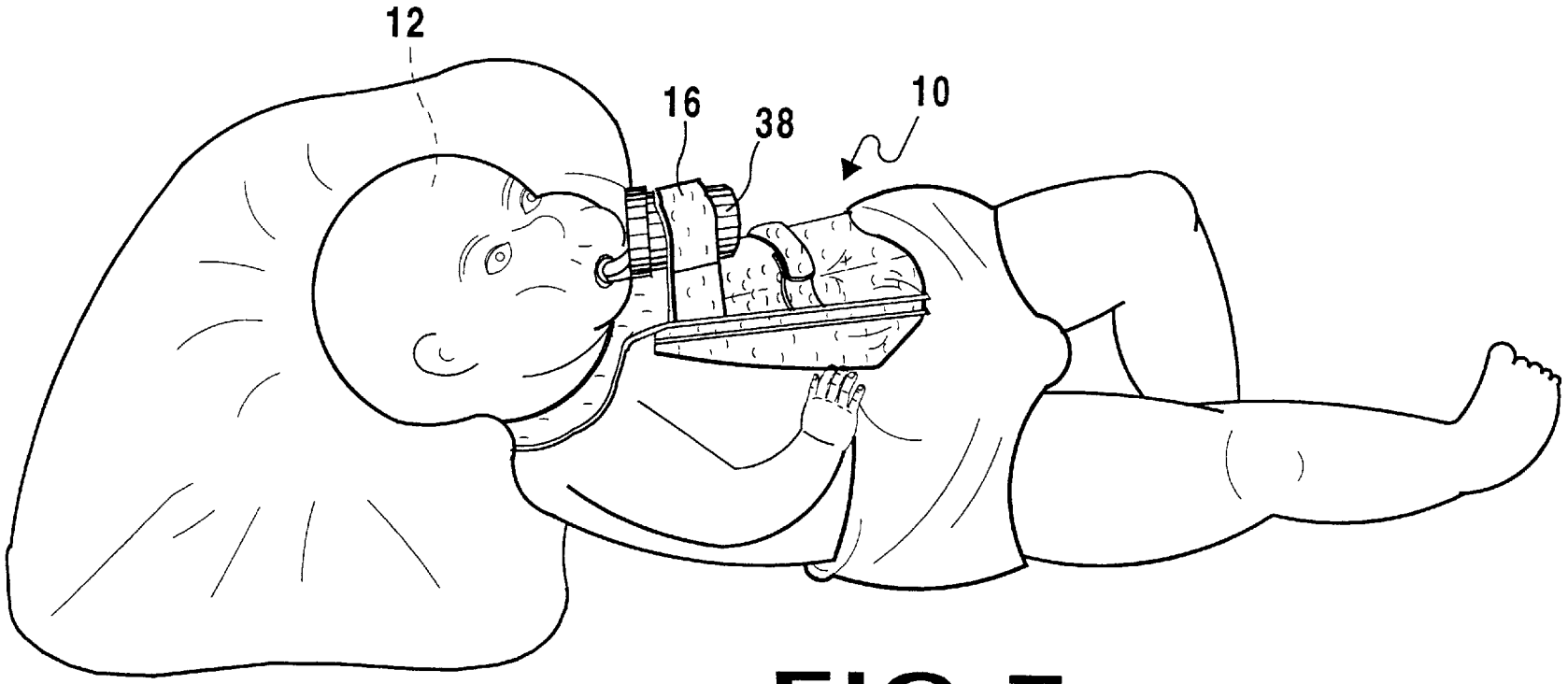
FIG. 7 is a side perspective view of the present invention in use whereby an infant in a prone position is wearing the infant feeding bib with the foam-like material wedge keeping a sip cup at the appropriate feeding angle by one of the adjustable straps with means for closure.

Turning to FIG. 7, therein is shown a side perspective view of the present invention 10 in operative connection with an infant 12 lying in the prone position using a sip cup 38 in place of a bottle. The infant 12 is wearing the infant feeding bib 10 with the wedge (not shown) keeping the sip cup 38 at an appropriate feeding angle by use of one of the adjustable straps 16 having means of closure as previously described.

Figure 8:
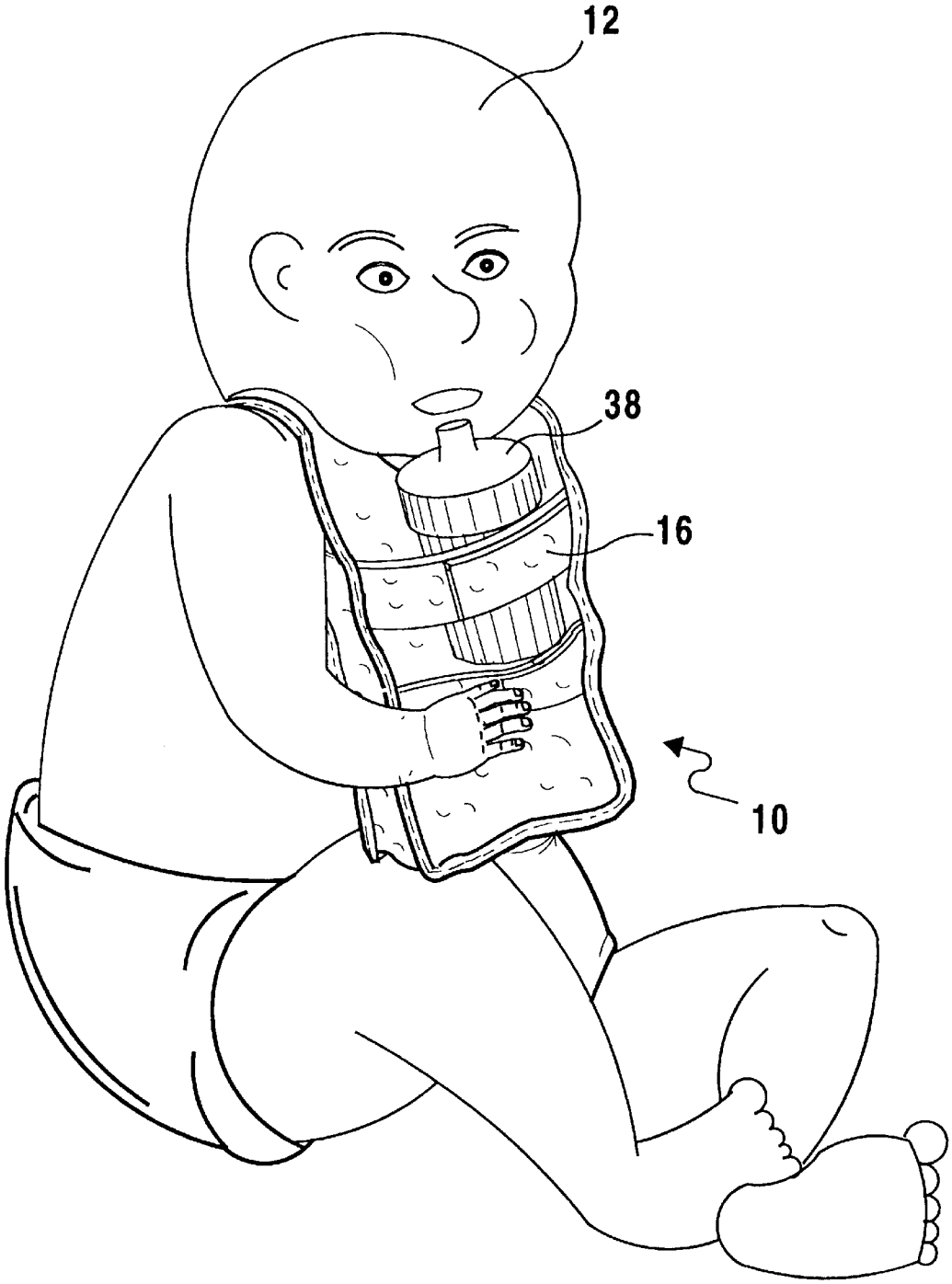
FIG. 8 is a side perspective view of the present invention in use whereby an infant in a sitting position is wearing the infant feeding bib with a sip cup.

Turning to FIG. 8, therein is shown a side perspective view of the present invention 10 in use by an infant 12 which infant is sitting in an upright position wearing the infant feeding bib 18 with a sip cup 38 held in place by strap 16.

Figure 9:
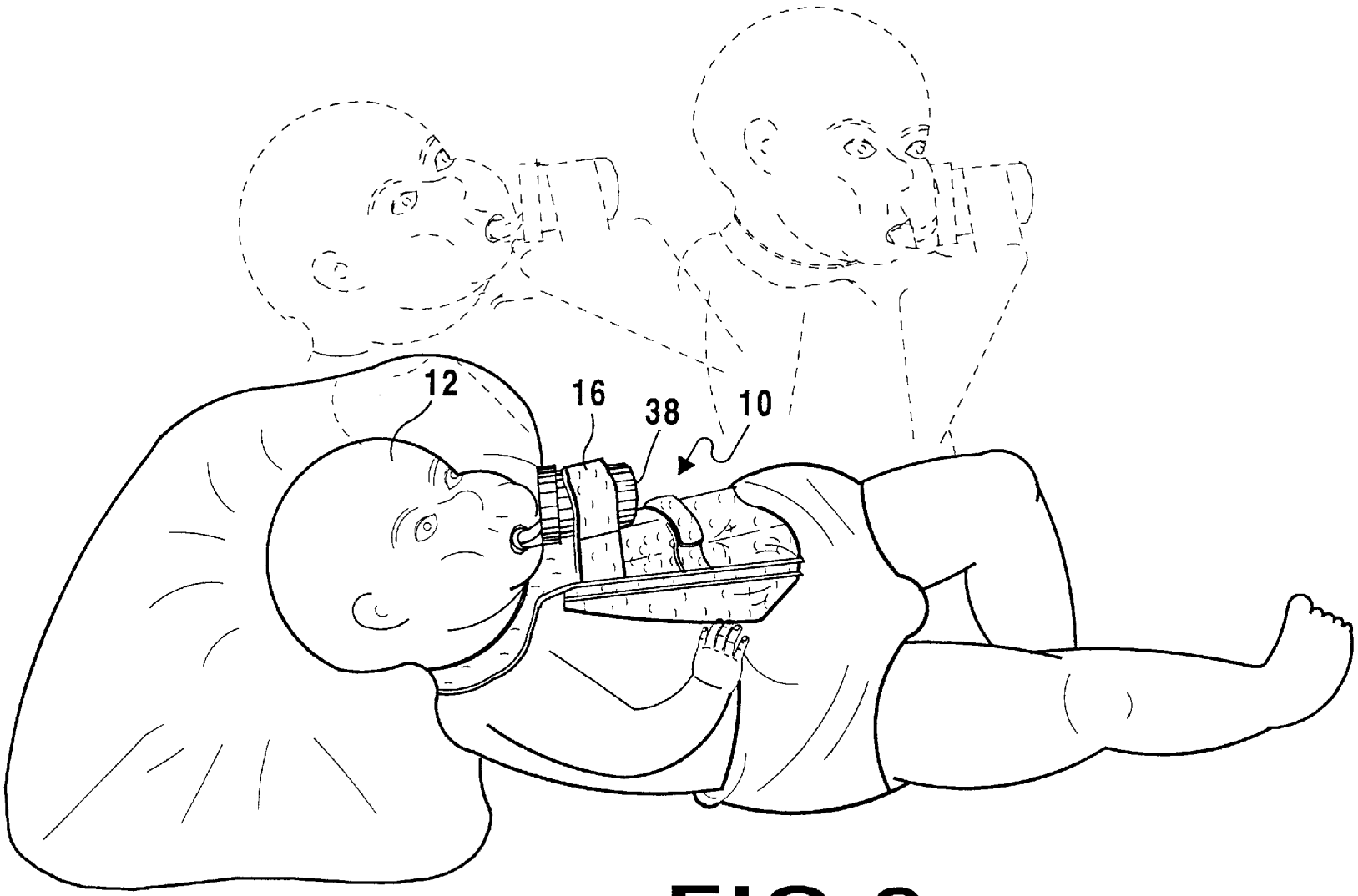
FIG. 9 is a perspective view of the present invention in use whereby an infant in a prone position is wearing the infant feeding bib with the foam-like material wedge keeping the sip cup at an appropriate feeding angle and said sip cup is being retained in said position by a number of elastic straps. Also shown in outline are alternate rotations for the foam-like wedge to maintain proper feeding angle for an infant.

Turning to FIG. 9, therein is shown a perspective view of the present invention 10, in operative connection with an infant 12 shown in a prone position wearing the infant feeding bib 10 with the internal wedge (not shown) keeping the sip cup 38 at an appropriate angle for feeding. The sip cup 38 is being retained in said position by strap 16. Also shown in outline are alternative positions or rotations for the wedge to maintain proper feeding angles for the infant while in different feeding positions.

DESCRIPTION OF REFERENCE NUMERALS

With regard to the reference numerals used, the following numbering is used throughout the various drawings.

10 bib of present invention
12 infant
14 bottle
16 straps
18 bib compartment
20 wedge
21 groove
22 opening into bib compartment
23 plastic liner
24 neck straps
26 neck strap hook and loop material
28 bottle strap hook and loop material
30 bib compartment hook and loop material
32 buttons
34 snaps
36 hooks
38 sip cup

What is claimed to be new and desired to be protected by letters patent is set forth in the claims:

1. An apparatus for holding a feeding device in a proper feeding position For an infant, comprising:

(a) a bib having a top surface and a bottom surface adapted to be placed on the chest of an infant;

(b) a first means for attaching said bib around the neck of an infant comprising neck straps extending from opposite sides of said bib;

(c) said bib having an inner compartment located between said top and bottom surfaces with an opening facing the head of said infant when said bib is worn;

(d) means for adjusting an angle between said top and bottom surfaces of said inner compartment comprising an irregularly shaped solid wedge inserted into said inner compartment which adjusts said angle by the orientation of said wedge within said inner compartment;

(e) said inner compartment having means for securing said opening in a closed position; and (f) second means for attaching an infant feeding device to said top surface of said bib, said infant feeding device being at an angle determined by the orientation of said wedge within said compartment.

2. The apparatus of claim 1, said means for securing of said opening of said inner compartment further comprising mating hook and loop material.

3. The apparatus of claim 1, said inner compartment further comprising being lined with plastic like material.

4. The apparatus of claim 1, said bib further comprising plastic like material.

5. The apparatus of claim 1, said bib further comprising vinyl laminate material.

6. The apparatus of claim 1, said bib further comprising cotton material.

7. The apparatus of claim 1, said bib further comprising terry cloth like material.

8. The apparatus of claim 1, said irregularly shaped wedge further comprising foam like material.

9. The apparatus of claim 8, said foam like material of said irregularly shaped wdege further comprises having a groove in its surface for receiving the circular shape of an infant feeding device.

10. The apparatus of claim 1, wherein said infant feeding device further comprises a baby bottle.

11. The apparatus of claim 1, wherein said infant feeding device further comprises a sip cup.

12. The apparatus of claim 1, said neck straps having mating hook and loop material on each end.

13. The apparatus of claim 1, said second means for attaching an infant feeding device to said bib further comprises multiple straps having connecting means to each other.

14. The apparatus of claim 13, said connecting means for said straps further comprises buttons.

15. The apparatus of claim 13, said connecting means for said straps further comprises snaps.

16. The apparatus of claim 13, said connecting means for said straps further comprises hooks.

17. The apparatus of claim 13, said connecting means for said straps further comprises mating hook and loop material.

18. The apparatus of claim 1, said second means for attaching an infant feeding device to said bib further comprises multiple elastic straps.

19. The method of holding a feeding device in a proper feeding position for an infant, comprising the steps of:

(a) placing a bib on the chest of an infant, said bib having a top surface and a bottom surface with an inner compartment located between said top and bottom surfaces with an opening facing the head of the infant when worn;

(b) attaching said bib around the neck of the infant using neck straps extending from opposite sides of said bib;

(c) inserting an irregularly shaped solid wedge in said inner compartment for adjusting an angle between said top and bottom surfaces and adjusting said angle by orienting said wedge within said inner compartment;

(d) securing said opening in a closed position; and (e) attaching an infant feeding device to said top surface of said bib, said infant feeding device being at an angle determined by the orientation of said wedge within said compartment.

* * * * *